US011359486B2

(12) United States Patent
Zhan et al.

(10) Patent No.: US 11,359,486 B2
(45) Date of Patent: Jun. 14, 2022

(54) MUD PULSER AND METHOD FOR OPERATING THEREOF

(71) Applicant: China Petroleum & Chemical Corporation, Beijing (CN)

(72) Inventors: Sheng Zhan, Houston, TX (US); Sam Seldon, Houston, TX (US)

(73) Assignee: China Petroleum & Chemical Corporation, Beijing (CN)

( * ) Notice: Subject to any disclaimer, the term of this patent is extended or adjusted under 35 U.S.C. 154(b) by 84 days.

(21) Appl. No.: 16/863,512

(22) Filed: Apr. 30, 2020

(65) Prior Publication Data

US 2021/0340864 A1 Nov. 4, 2021

(51) Int. Cl.

| | |
|---|---|
| ***E21B 47/18*** | (2012.01) |
| ***E21B 21/12*** | (2006.01) |
| ***E21B 34/16*** | (2006.01) |
| ***E21B 17/22*** | (2006.01) |
| ***E21B 17/00*** | (2006.01) |

(52) U.S. Cl.

CPC ..... *E21B 47/18* (2013.01); *E21B 17/006* (2013.01); *E21B 17/22* (2013.01); *E21B 21/12* (2013.01); *E21B 34/16* (2013.01)

(58) Field of Classification Search

CPC ..... E21B 47/12; E21B 47/14; E21B 47/18; E21B 47/20; E21B 47/22; E21B 47/24; E21B 17/006; E21B 17/22; E21B 21/12; E21B 34/16

See application file for complete search history.

(56) References Cited

U.S. PATENT DOCUMENTS

| | | | | |
|---|---|---|---|---|
| 6,016,288 | A * | 1/2000 | Frith | E21B 47/24 367/85 |
| 7,467,658 | B2 * | 12/2008 | Kent | E21B 36/006 166/302 |
| 8,689,884 | B2 * | 4/2014 | Young | E21B 47/06 166/373 |
| 9,638,025 | B2 * | 5/2017 | Pare | E21B 47/12 |
| 2010/0243401 | A1 * | 9/2010 | Diosi | F16H 63/3026 192/85.17 |
| 2019/0301267 | A1 * | 10/2019 | Segura | E21B 34/066 |

* cited by examiner

*Primary Examiner* — Franklin D Balseca
(74) *Attorney, Agent, or Firm* — Novick, Kim & Lee, PLLC; Allen Xue

(57) ABSTRACT

A pulser for generating pressure pulses propagating through a column of drilling fluid in the drill string to the surface during drilling. The pulser may include a screen in the surface of a tubular housing to permit mud from the mud stream to enter into the pulser; an adjustable servo valve configured to receive the mud and including a removable servo poppet and a removable servo orifice member positioned in the tubular housing, wherein the adjustable servo valve is configured to allow the removable servo poppet and the removable servo orifice member to be replaced by another removable servo poppet and another removable servo orifice member to alter an inner diameter of an orifice of the adjustable servo valve to accommodate drilling conditions to increase a performance of the pulser generating pressure pulses for the mud stream returning to the surface.

16 Claims, 6 Drawing Sheets

MUD PULSER AND METHOD FOR OPERATING THEREOF

TECHNICAL FIELD

The present disclosure provides an oil drilling system including a drill string with a pulser which generates pulses representing information to be transmitted from the drill string to the surface. The pulser is a mechanical module or mechanical device, which includes an adjustable servo valve with a unique two-part configuration providing a common outer diameter (OD) to receive poppet servo valves and orifice members of different sizes to provide different inner diameters (ID) of orifices for the adjustable servo valve.

BACKGROUND

In the drilling of deep bore holes for the exploration and extraction of crude oil and natural gas, the "rotary" drilling technique has become a commonly accepted practice. This technique involves using a drill string, which consists of numerous sections of hollow pipe connected together and to the bottom end of which a drilling bit is attached. By exerting axial forces onto the drilling bit face and by rotating the drill string from the surface, a reasonably smooth and tubular bore hole is created. The rotation and compression of the drilling bit causes the formation being drilled to be successively crushed and pulverized. Drilling fluid, frequently referred to as "drilling mud" or "mud," is pumped down the hollow center of the drill string, through nozzles on the drilling bit and then back to the surface around the annulus of the drill string. This fluid circulation is used to transport the cuttings from the bottom of the bore hole to the surface where they are filtered out and the drilling fluid is re-circulated as desired. The flow of the drilling fluid, in addition to removing cuttings, provides other secondary functions such as cooling and lubricating the drilling bit cutting surfaces as well as exerting a hydrostatic pressure against the bore hole walls to help contain any entrapped gases that are encountered during the drilling process.

To enable the drilling fluid to travel through the hollow center of the drill string and the restrictive nozzles in the drilling bit and to have sufficient momentum to carry cuttings back to the surface, the fluid circulation system includes a pump or multiple pumps capable of sustaining sufficiently high pressures and flow rates, piping, valves and swivel joints to connect the piping to the rotating drill string.

Since the advent of drilling bore holes, the need to measure certain parameters at the bottom of the bore hole and provide this information to the driller has been recognized. These parameters include but are not limited to the temperature and pressure at the bottom of a bore well, the inclination or angle of the bore well, the direction or azimuth of the bore well, and various geophysical parameters that are of interest and value during the drilling process. The challenge of measuring these parameters in the hostile environment at the bottom of the bore hole during the drilling process and somehow conveying this information to the surface in a timely fashion has led to the development of many devices and practices.

There are obvious advantages to being able to send data from the bottom of the well to the surface while drilling without a mechanical connection or specifically using wires. This has resulted in Measuring-While-Drilling (MWD) instruments, which are widely used in oil and gas drilling and formation evaluation. For example, these MWD instruments may be installed in a bottom whole assembly (BHA) of a drill string coupled to a derrick above the earth surface. The MWD instruments may be part of an MWD system (MWD assembly) in the BHA of the drill string.

Communicating information including measurement data from the MWD instruments in the ground to a computing device on the surface may be accomplished using a pulser, which generates and transmits pressure pulses through a column of drilling fluid in the drill string to one or more sensors connected a pressure sensitive transducer and further to a computing device located on the surface. The pressure pulses represent data and are generated by using a valve mechanism in the pulser. However, there are drawbacks with existing pulser technologies, including clogging, lack of proper lubrication, as well as weak pressure pulses, e.g., in deep wells.

Accordingly, there is a need for a new pulser for efficiently and reliably generating and transmitting pressure pluses through the drilling fluid to a pressure sensor located on the surface.

SUMMARY

This disclosure provides devices, apparatuses, and methods for generating pressure pulses that propagate through a column of drilling mud in the drilling stream back to surface during drilling. Used herein, the pulser may be referred to as a "pressure pulse generator," "pulser mechanical module," or "pulser device."

In one of the embodiment of this disclosure, a pulser includes a tubular housing, a pressure compensation piston separating the tubular housing into a proximal portion and a distal portion, an electric motor resides in the proximal portion, a servo valve resides in the distal portion, a piston shaft coupled to the electric motor and extends through the pressure compensation piston into the distal portion, and one or more metal screens affixed to a surface of the distal portion of the tubular housing, configured to allow the drilling fluid to enter the tubular housing.

In one aspect of the embodiment, the electric motor causes the poppet shaft to reciprocate along a longitudinal direction of the tubular housing. The servo valve comprises a poppet detachably affixed to the poppet shaft and an orifice member having an orifice that allows the drilling fluid to pass, wherein a reciprocating motion of the poppet shaft causes the poppet to close or open the orifice, thereby stopping or releasing a flow of the drilling fluid through the pulser.

In one embodiment, each of the one or more metal screens includes a plurality of screen members positioned to form a plurality of slits to allow the drilling fluid to flow into the distal end of the tubular housing, wherein each of the plurality of slits is oriented so that a middle point of the slit is positioned distal to two ends of the slit.

In one aspect of the embodiment, the pulser has an orifice housing disposed in the distal portion of the tubular housing and the orifice member is detachably affixed to the orifice housing.

In a further aspect, the orifice in the orifice member has a diameter ranging from 0.2" to 0.5", and the poppet has a size that matches the orifice.

In still one embodiment, the orifice housing is detachably affixed to the tubular housing and detaching the orifice housing from the tubular housing exposes the poppet so that the poppet is accessible and can be removed from the tubular housing.

The pulser may still include a compression spring disposed in the distal portion of the tubular housing and exerts a force against the pressure compensation piston. During operation, the proximal portion is filled with a lubricant and the distal portion is filled with the drilling fluid, wherein the pressure compensation piston moves along the longitudinal direction of the tubular housing in response to a pressure difference between the lubricant and the drilling fluid.

In another embodiment of the pulser, the pressure compensation piston includes a spiral pattern on an outer surface of the pressure compensation piston and the inner surface of the pressure compensation piston. The spiral pattern may include a plurality of spiral grooves of a rectangular shape. During operation, the lubricant fills the spiral grooves. In a further aspect, each of the spiral grooves is about 1/16 inches wide and about 1/32 inches deep, and wraps around the inner diameter and the outer diameter at approximately one revolution for every two inches of a length of the pressure compensation piston.

In still another embodiment, the pulser may contain a pressure balance plate disposed between the pressure compensation piston and the compression spring.

Further, the pulser may have a first sealing ring that seals a gap between the pressure compensation piston and the tubular housing and a second sealing ring that seals a gap between the pressure compensation piston and the piston shaft.

This disclosure provides a method to prepare the pulser of claim 1 for operation. The method includes steps of estimating a depth of the pulser in a bore hole; estimating an amplitude of pressure pulses required for the pressure pulses to propagate from the estimated depth to the surface; selecting a diameter of the orifice and the poppet required for generating pressure pulses of the estimated amplitude; installing the orifice member having the selected orifice of and the poppet in the pulser. For example, when the estimated amplitude of the pressure pulses is about 500 psi, the selected orifice may have a diameter of 0.5 inches.

In one aspect of the embodiment, the method also includes step of removing an orifice housing from the pulser; affixing the poppet to the poppet shaft; affixing the orifice member to the orifice housing; and installing the orifice housing with the orifice member to the pulser.

Further, the orifice member is selected from a plurality of orifice members having a common outer diameter, and each of the plurality of orifice members has an orifice of different diameter.

BRIEF DESCRIPTION OF THE DRAWINGS

The teachings of the present invention can be readily understood by considering the following detailed description in conjunction with the accompanying drawings.

DETAILED DESCRIPTION

Figure 1:
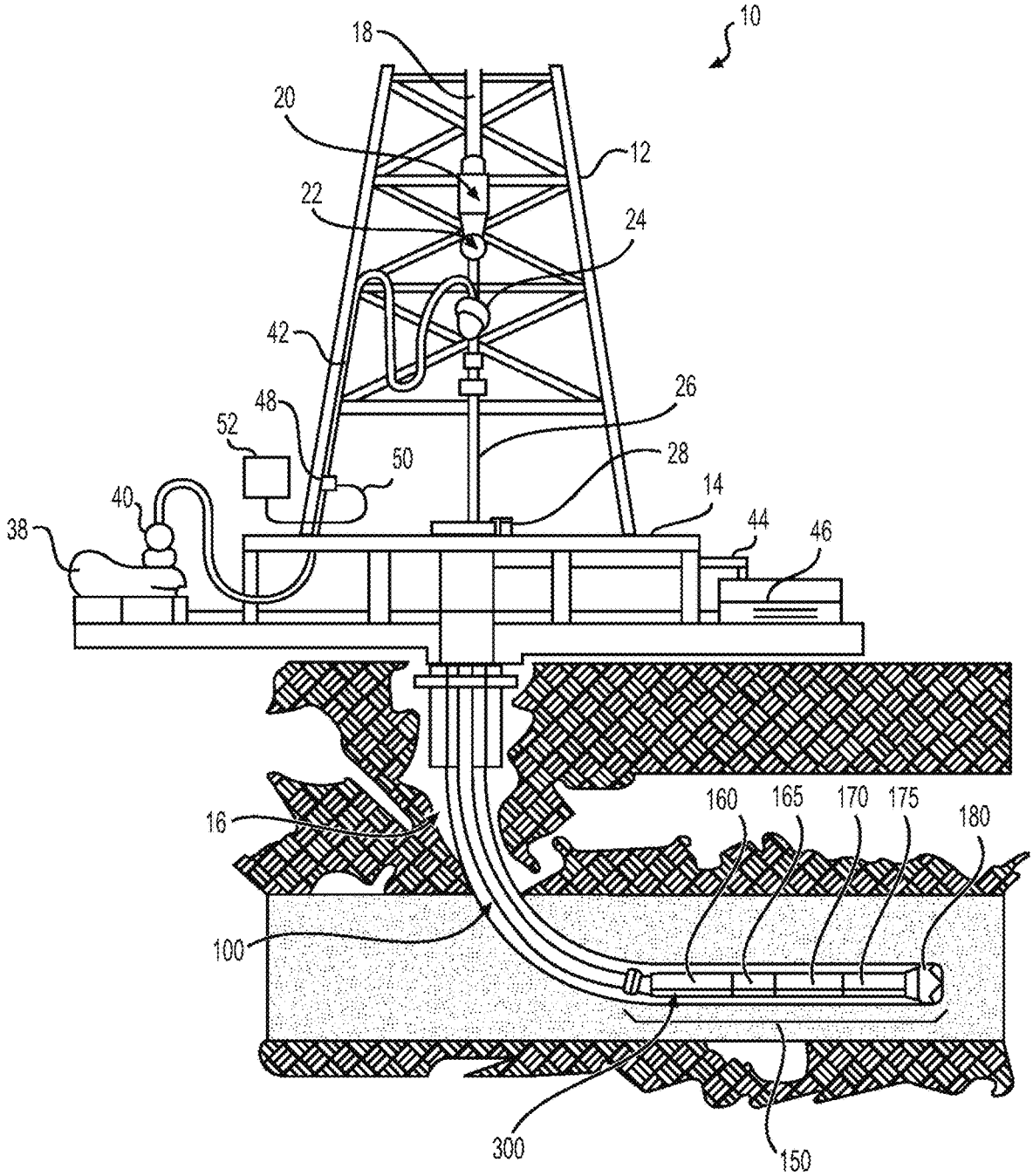
FIG. 1 is a schematic diagram showing an oil drilling system at a wellsite according to an embodiment.

Reference will now be made in detail to embodiments of the present disclosure, examples of which are illustrated in the accompanying drawings. It is noted that wherever practicable, similar or like reference numbers may be used in the drawings and may indicate similar or like elements.

The drawings depict embodiments of the present disclosure for purposes of illustration only. One skilled in the art would readily recognize from the following description that alternative embodiments exist without departing from the general principles of the disclosure.

In one or more exemplary embodiments, information of use to the driller may be measured at the bottom of a bore hole relatively close to the drilling bit and this information is transmitted to the surface using pressure pulses in a drilling fluid circulation loop. The command to initiate the transmission of data may be sent by stopping drilling fluid circulation and allowing the drill string to remain still for a minimum period of time. Upon detection of this command, a measuring-while-drilling (MWD) system (MWD assembly or MWD tool) may measure at least one downhole condition, usually an analog signal, and this signal may be processed by the MWD tool and readied for transmission to the surface. When the drilling fluid circulation is restarted, the MWD tool may wait a predetermined amount of time to allow the drilling fluid flow to stabilize and then begin transmission of the information by repeatedly closing and then opening a pulser valve to generate pressure pulses in the drilling fluid circulation loop. The sequence of pulses sent is encoded into a format that allows the information to be decoded at the surface and the embedded information extracted and displayed on a display screen.

More specifically, a novel pulser ("pressure pulse generator", "pulser mechanical module", or "pulser device") may be coupled to a sensor package, a controller and a battery power source all of which reside inside a short section of drill string close to the bit at the bottom of the bore hole being drilled. The MWD system can be commanded from the surface to measure desired parameters and to transmit measurement data to the surface. Upon receiving the command to transmit information, a downhole controller gathers pertinent data from the sensor package and transmits this information to the surface by encoding data in pressure pulses. These pressure pulses travel up the drilling fluid column inside the drill string and are detected at the surface by a pressure sensitive transducer coupled to a computer which decodes and displays the transmitted data on a display screen.

The measuring-while-drilling (MWD) systems may for example contain a survey tool that measures formation properties (e.g. resistivity, natural gamma ray, porosity), wellbore geometry (inclination, azimuth), drilling system orientation (tool face), and mechanical properties of the drilling process for drilling a well. MWD instruments or systems measure wellbore trajectory, provide magnetic or gravity tool faces for directional control and a telemetry system that pulses data up through the drill string as pressure waves (i.e., generating pressure pulses which propagate through a mud column).

Referring now to the drawings and specifically to FIG. 1, there is generally shown therein a diagram of an oil drilling system 10 used in the directional drilling of bore holes 16. The oil drilling system 10 may be used for drilling on land as well as beneath the water. A bore hole 16 is drilled into the earth formation using a rotary drilling rig that includes a derrick 12, drill floor 14, draw works 18, traveling block 20, hook 22, swivel joint 24, kelly joint 26 and rotary table 28. A drill string 100 used to drill the bore well includes a plurality of drill pipes that are serially connected and secured to the bottom of the kelly joint 26 at the surface. The rotary table 28 is used to rotate the entire drill string 100 while the draw works 18 is used to lower the drill string 100 into the bore hole 16 and apply controlled axial compressive loads. The lower part of the drill string 100 is a bottom whole assembly 150.

The drilling fluid (also referred to as mud) is usually stored in mud pits or mud tanks 46, and is transferred using a mud pump 38, which forces the drilling fluid to flow through a surge suppressor 40, then through a kelly hose 42, and through the swivel joint 24 and into the top of the drill string 100. The drilling fluid flows through the drill string 100 at about 150 gallons per minute to about 600 gallons per minute and flows into the bottom whole assembly 150. The drilling fluid then returns to the surface by traveling through the annular space between the outer surface of the drill string 100 and the bore hole 16. When the drilling fluid reaches the surface, it is diverted through a mud return line 44 back to the mud tanks 46.

The pressure required to keep the drilling fluid in circulation is measured by a pressure sensitive transducer 48 on the kelly hose 42. The pressure sensitive transducer detects changes in pressure caused by the pressure pulses generated by a pulser 300 in FIG. 1. The magnitude of the pressure wave from the pulser may be up to 500 psi or more. The measured pressure is transmitted as electrical signals through transducer cable 50 to a surface computer 52, which decodes and displays the transmitted information. Alternatively, the measured pressure is transmitted as electrical signals through transducer cable 50 to a decoder which decodes the electrical signals and transmits the decoded signals to a surface computer 52 which displays the data on a display screen.

As indicated above, the lower part ("distal part") of the drill string 100 includes the bottom hole assembly (BHA) 150, which includes a non-magnetic drill collar with a MWD system (MWD assembly or MWD tool) 160 installed therein, logging-while drilling (LWD) instruments 165, a downhole motor 170, a near-bit measurement sub 175, and the drill bit 180 having drilling nozzles (not shown). The drilling fluid flows through the drill string 100 and is output through the drilling nozzles of the drill bit 180. During the drilling operation, the drilling system 10 may operate in the rotary mode, in which the drill string 100 is rotated from the surface either by the rotary table 28 or a motor in the traveling block 20 (i.e., a top drive). The drilling system 10 may also operate in a sliding mode, in which the drill string 100 is not rotated from the surface but is driven by the downhole motor 170 rotating the drill bit 180. The drilling fluid is pumped from the surface through the drill string 100 to the drill bit 180, being injected into an annulus between the drill string 100 and the wall of the bore hole 16. As discussed above, the drilling fluid carries the cuttings up from the bore hole 16 to the surface. Bore hole 16 may also be referred to as a well or drilling well.

In one or more embodiments, the MWD system 160 may include a pulser sub, a pulser driver sub, a battery sub, a central storage unit, a master board, a power supply sub, a directional module sub, and other sensor boards. In some embodiments, some of these devices may be located in other areas of the BHA 150. One or more of the pulser sub and pulser driver sub may communicate with the pulser 300, which may be located below the MWD system 160. The MWD system 160 can transmit data to the pulser 300 so that the pulser 300 generates pressure pulses, which will be described in detail in the description of FIGS. 2 and 3.

The non-magnetic drill collar houses the MWD system 160, which includes a package of instruments for measuring inclination, azimuth, well trajectory (bore hole trajectory), etc. Also included in the non-magnetic drill collar or other locations in the drill string 100 are LWD instruments 165 such as a neutron-porosity measurement tool and a density measurement tool, which are used to determined formation properties such as porosity and density. The instruments may be electrically or wirelessly coupled together, powered by a battery pack or a power generator driven by the drilling fluid. All information gathered may be transmitted to the surface via in the form of pressure pulses through the mud column in the drill string.

The near-bit measurement sub 175 may be disposed between the downhole motor 170 and drill bit 180, measuring formation resistivity, gamma ray, and the well trajectory. The data may be transmitted through the cable embedded in the downhole motor 170 to the MWD system 160 in the bottom whole assembly 150. A pulser 300 may be positioned below the MWD system 160 to communicate with the MWD system 160.

Figure 2:
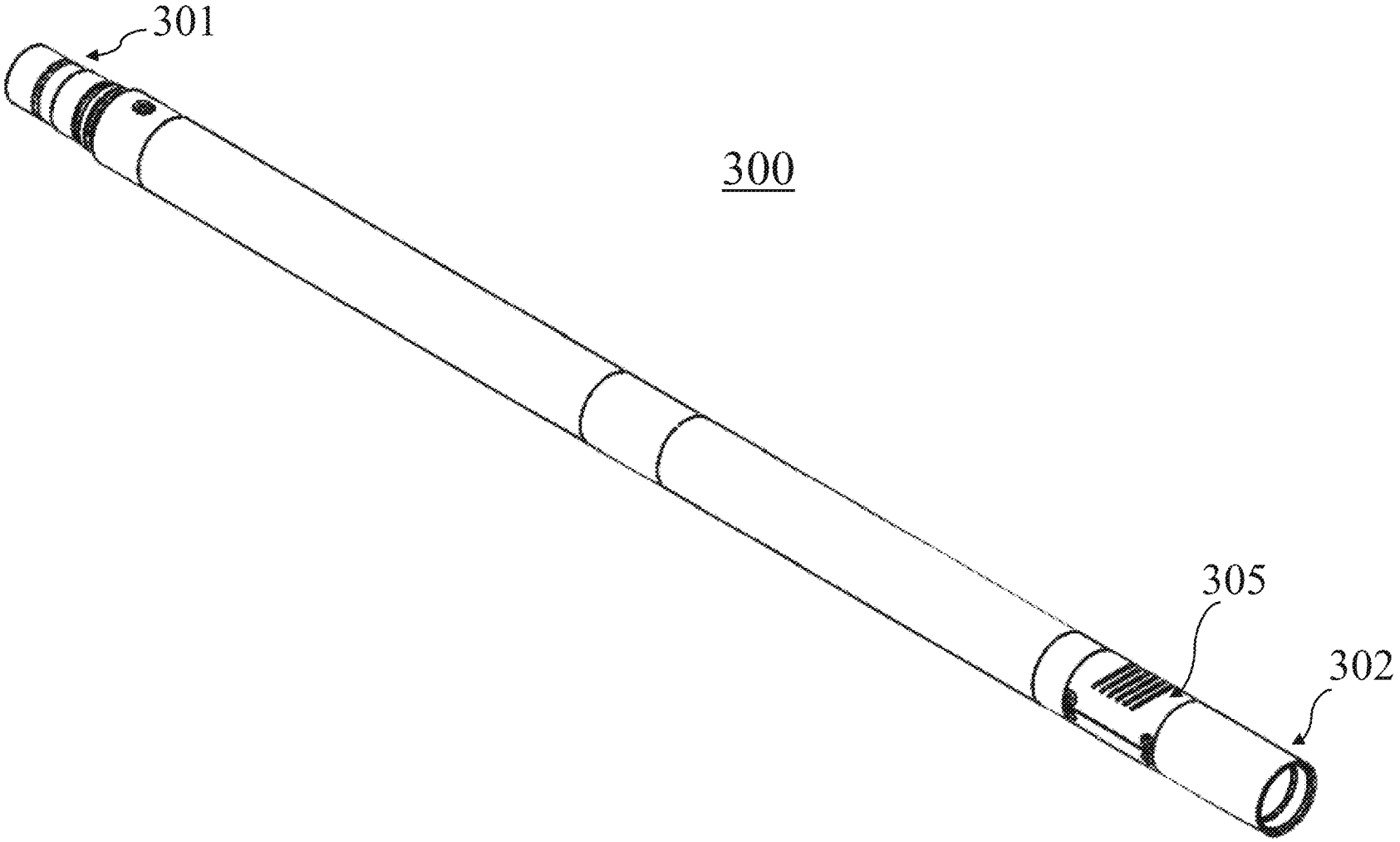
FIG. 2 is a schematic diagram showing a plan view of a pulser according to an embodiment.
Figure 3:
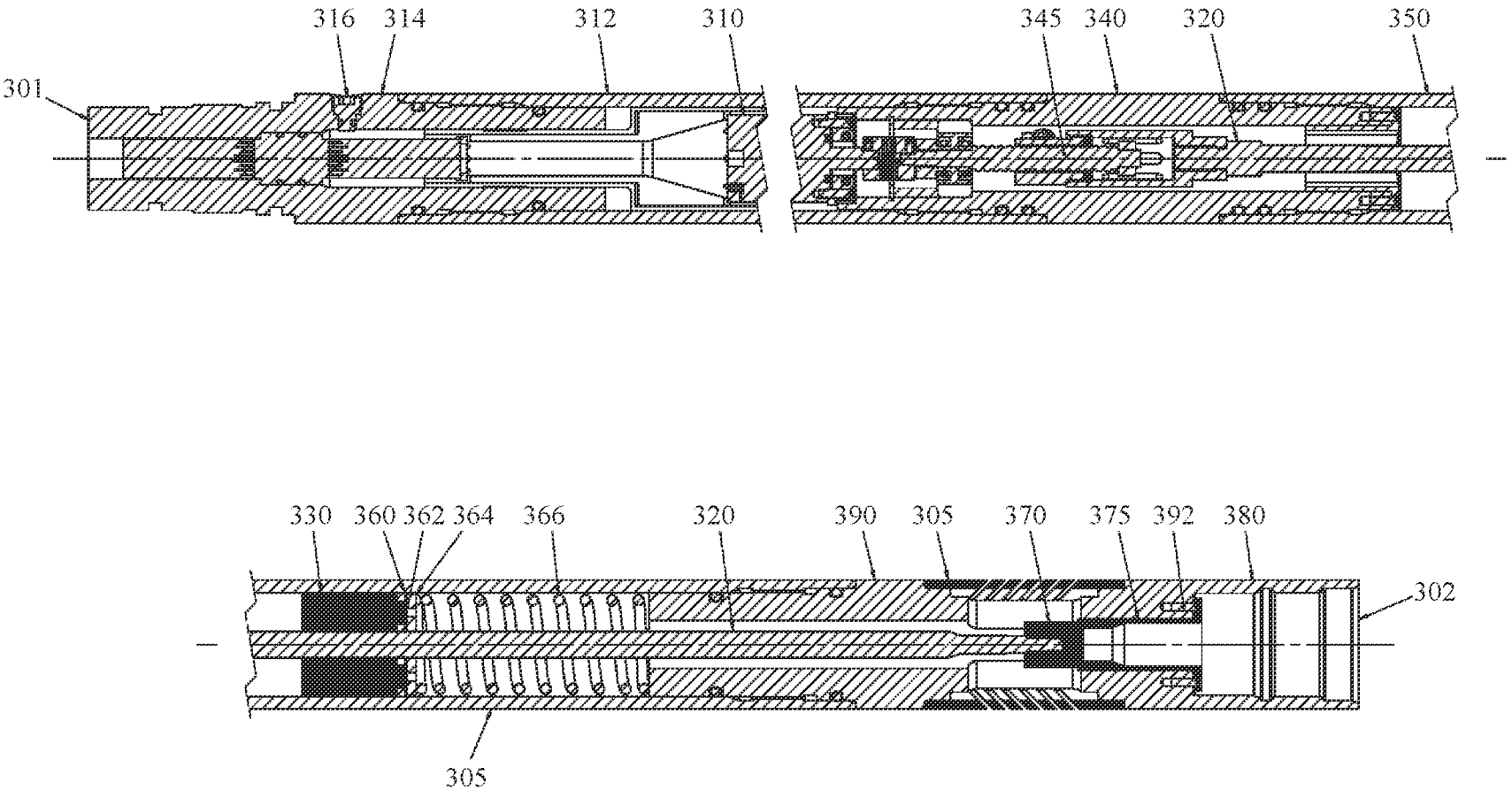
FIG. 3 is a schematic diagram showing a section view of a pulser according to an embodiment.

FIG. 2 is a perspective view of an example of pulser 300 according to an embodiment. In this exemplary embodiment, the pulser has a tubular housing with a proximal end 301 and a distal end 302. In this exemplary embodiment, the length of the pulser 300 may be 40 to 41 inches (such as 40.785 inches) and the diameter of the pulser 300 may be 1 to 2 inches (such as 1.875 inches). In this exemplary embodiment, the pulser 300 may have a pair of semi-annular anti-LCM (lost circulation material) screens 305 including unique back-cut openings to allow the drilling fluid to easily flow into a servo value within the pulser 300. One anti-LCM screen 305 is shown in the view of the pulser 300 in FIG. 2. A pair of screens 305 is shown in FIG. 3. The unique back-cut openings of the anti-LCM screen 305 prevents larger and heavier LCM from flowing into the servo valve in the pulser 300 to prevent the pulser 300 from clogging and malfunctioning. For example, the screen 305 may have a length between 2 inches and 4 inches (such as 2.865 inches). The screen 305 may have screen members 306, which preferably cut against the flow of the drilling fluid by an angle of approximately 45 degrees. The slit between two adjacent screen members 306 may be 0.25 inches in width. The middle point of the slit is at the lower point while two ends of the slit is its middle point so that the drilling fluid makes a sharp turn when entering the pulser through the screens 305, thereby preventing solid materials in the drilling fluid, e.g., greater than 1/16 of an inch, from entering the pulser 300. The screen members are denoted by reference numeral 306 in FIG. 3.

FIG. 3 is a schematic diagram showing the interior of the pulser 300 in an embodiment. The pulser 300 includes a tubular housing. The tubular housing includes a motor housing 312, an oil fill housing 314, a ball screw housing 340, and a pressure compensation piston housing 350. A motor 310 is positioned in the motor housing 312, and a ball screw 345 is positioned in the ball screw housing 340. The motor 310 drives a poppet shaft 320 through a ball screw 345 so that the poppet shaft 320 makes reciprocating motion along the longitudinal direction of the tubular housing, causing the servo valve to open or close and generating pressure pulses in the drilling fluid, as discussed in details elsewhere in the specification. The pressure pulses propagate in the mud column in the drill string to the pressure sensitive transducer 48 at the surface. The motor 310 may receive instructions from a downhole controller, which may be located in the MWD system 160.

The oil fill housing 314 is sealed by an oil fill plug 316. The oil fill plug 316 can be removed to permit lubricant (e.g., mineral oil) to be added into the oil housing 314. The pressure of the lubricant in the pulser can be adjusted at the time of filling.

Figure 4:
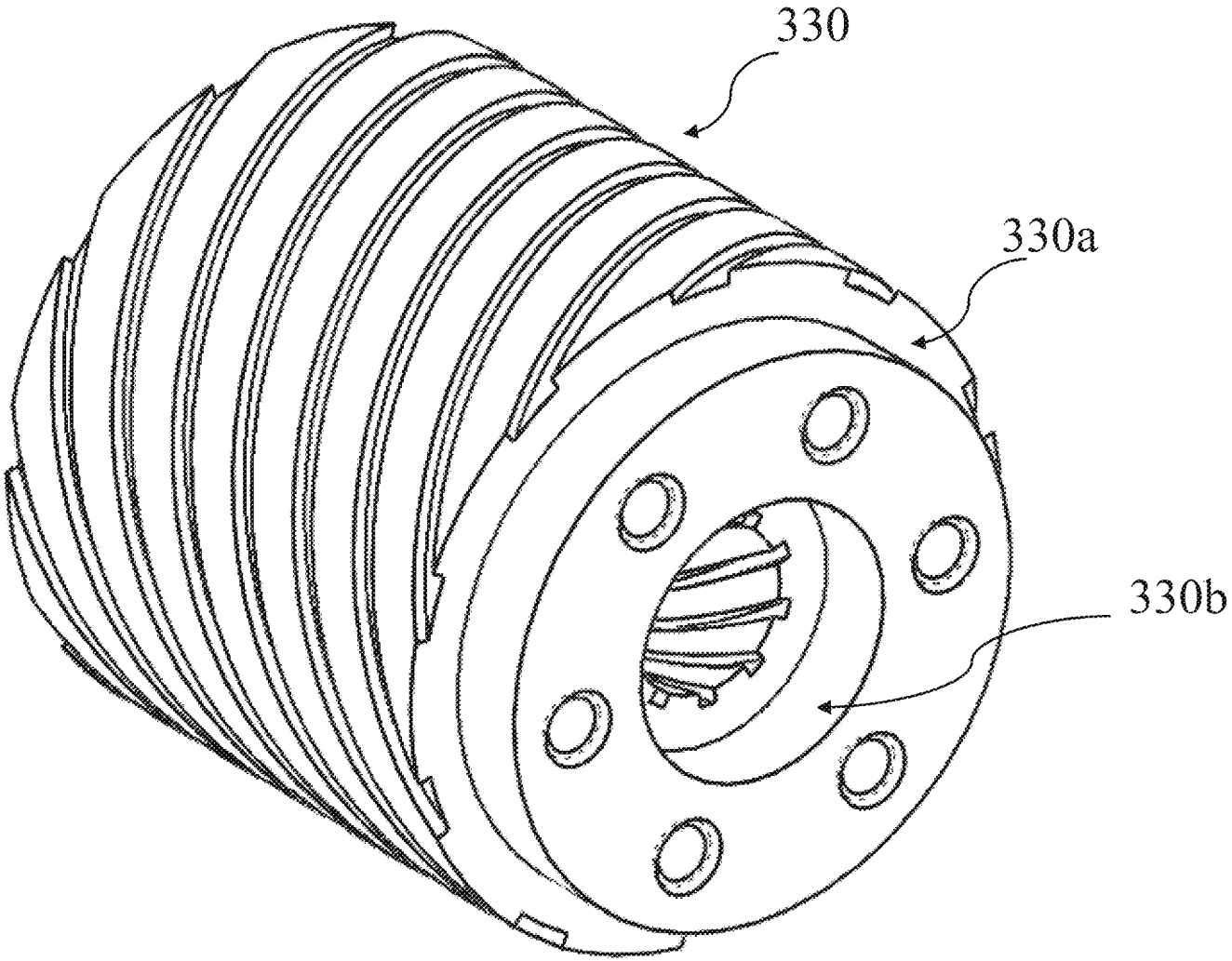
FIG. 4 is a schematic diagram showing a pressure balance piston according to an embodiment shown in FIG. 3.

Referring to FIGS. 3 and 4, a compression spring 366 is positioned in the pressure compensation piston housing 350 between the pressure balance piston plate 364 and the servo valve housing 390. The poppet shaft 320 extends sequentially through the pressure compensation piston 330, the pressure balance piston plate 364, the compression spring 366, and the servo valve housing 390 into a cavity surrounded by metal screens 305.

The pressure compensation piston 330 is cylindrical in shape. It has a center through hole in its longitudinal direction to accommodate the poppet shaft 320. The distal end of the piston 330 has as a step 330*a* disposed about its outer surface and a step 330*b* disposed about the inner surface of the through hole. A first X-ring 360 is disposed in step 330*a* and a second X-ring 362 is disposed in step 330*b*. Accordingly, X-ring 360 seals the gap between piston 330 and the wall of the piston housing 350, while X-ring 362 seals the gap between the piston 330 and the poppet shaft 320. As such, the pressure compensation piston 330 separates the pulser into a proximal portion (the portion closer to the ground surface) and a distal portion (the portion close to the bottom of the bore hole). The piston 330 prevents the drilling fluid in the distal portion and the lubricant oil in the proximal portion from leaking into each other.

According to the embodiment in FIG. 4, piston 330 has ten helical grooves of a rectangular shape, which are about 1/16 inches wide and about 1/32 inches deep. The pressure compensation piston 330 may be about 1.525 inches in length. The pitch of the helical grooves is 2 inches per helix turn. The grooves are filled with lubricant oil to reduce friction between the inner surface of the piston 330 and the poppet shaft 320 as well as between the outer surface of the piston 330 and the inner surface of the housing 350.

The piston 330, the pressure balance piston plate 364, and the compression spring 366 work together to balance the pressure between the lubricant oil in the proximal portion and the drilling fluid in the distal portion of the pulser. During operation, the compression spring 366 is in a compressed state and the lubricant oil in the proximal portion and the drilling fluid in the distal portion are pressure-balanced. When the servo valve is closed so that the pressure of the drilling fluid increases, the drilling fluid exerts a higher pressure on the plate 364, which pushes piston 330 to the proximal direction, thereby increasing the pressure of the lubricant oil in the proximal portion. When the servo valve opens, the pressure of the drilling fluid reduces, piston 330 moves in the distal direction so as to reduce the pressure of the lubricant oil. Accordingly, the reciprocating movement of the piston 330 balances the pressure between the lubricant in the proximal portion and the drilling fluid in the distal portion.

The pressure of the drilling fluid can be up to 30,000 psi in a drilling operation while the magnitude of the pressure pulse can be up to 500 psi, which may require high pressure and high temperature metal seals. However, since the lubricant oil is almost an incompressible fluid, a slight change in its volume generates a large counter pressure, which balances out the pressure from the drilling fluid. Thus this configuration making it unnecessary to use an expensive high pressure, high temperature reciprocating seal. Accordingly, sealing materials in the pulser 300 (e.g., first X-ring and second X-ring) may only need to be selected to sustain high temperature of the operating environment and less concerned about high pressure, making it the pulser cheaper to make as well as more reliable during operation.

Referring to FIG. 3, this schematic diagram shows the interior of the pulser 300 with a unique two-part configuration of a servo valve. As discussed above, the pulser 300 is a mechanical module or mechanical device, which includes an adjustable servo valve with a unique two-part configuration providing a common outer diameter (OD) to receive poppet servo valves and orifice members having different inner diameters (ID) of orifices for the adjustable servo valve. The motor 310 drives a poppet shaft 320 through a ball screw 345 to open and close an adjustable servo valve so that a pressure pulse can be generated and transmitted through a mud column to the pressure sensitive transducer 48 at the surface. For example, the adjustable servo valve may include a poppet 370 and an orifice member 375. The orifice member 375 may also be referred to as an orifice plate. The tubular housing of the pulser 300 includes an orifice housing 380. One or more screws 392 may fasten the orifice member 375 to housing 380.

The orifice member 375 has an orifice, which is opened and closed by the poppet 370 affixed to the tip of the poppet shaft 320. The inner diameter 396 of the orifice may be 0.2 inches to 0.5 inches in an embodiment in FIG. 3. The motor 310 drives the ball screw 345 to retract the poppet shaft 320, which moves the poppet 370 to open the servo valve orifice and allows the drilling fluid to flow through the orifice. When the motor 310 drives the ball screw 345 to thrust the poppet shaft 320 in the distal direction, the servo valve poppet 370 to close the servo valve orifice and stops the drilling fluid from exiting. Accordingly, the opening-closing of the orifice allows the drilling fluid to flow into a lower end assembly (not shown) attached to the distal end of the pulser 302, and from the lower end assembly outputs pressure pulses into the mud column to the pressure sensitive transducer 48 on the surface. As discussed above, the motor 310 receives signals from the MWD system 160 to instruct the motor 310 to generate the pressure pulses. The lower end assembly is commercially available, for example, from Enteq Drilling SHO in Houston, Tex.

As discussed above, the adjustable servo valve shown in FIG. 3 has a unique two-part design including a poppet 370 and an orifice member 375. This unique two part design provides a common outer diameter (OD) of the servo valve while allowing different inner diameters (ID) for the servo valve. The inner diameter may be in a range of approximate 0.2 inches to 0.5 inches. The common OD allows the servo valve parts to be changed (adjusted) as desired to accommodate expected drilling conditions to increase the performance of the pulser 300. For example, when drilling an ultra-deep well, a servo valve with a large ID (e.g. ½ inch) may be used to allow more drilling fluid to flow through the orifice during each period the servo valve is opened, which will produce a stronger pressure pulse that can be more easily detected by a pressure sensitive transducer 48 and decoded at the surface by a decoder, which may be in the surface computer 52. FIG. 3 is example of a servo valve with a large ID. The poppet 370 and orifice member 375 may be removed from the adjustable servo valve through the distal end 302 of the pulser 300, so that another poppet and orifice member, provides a different ID such as a smaller ID, can be inserted into the adjustable servo valve. However, the another poppet and another orifice member provide the same outer diameter as provided by the orifice member 375.

Figure 5:
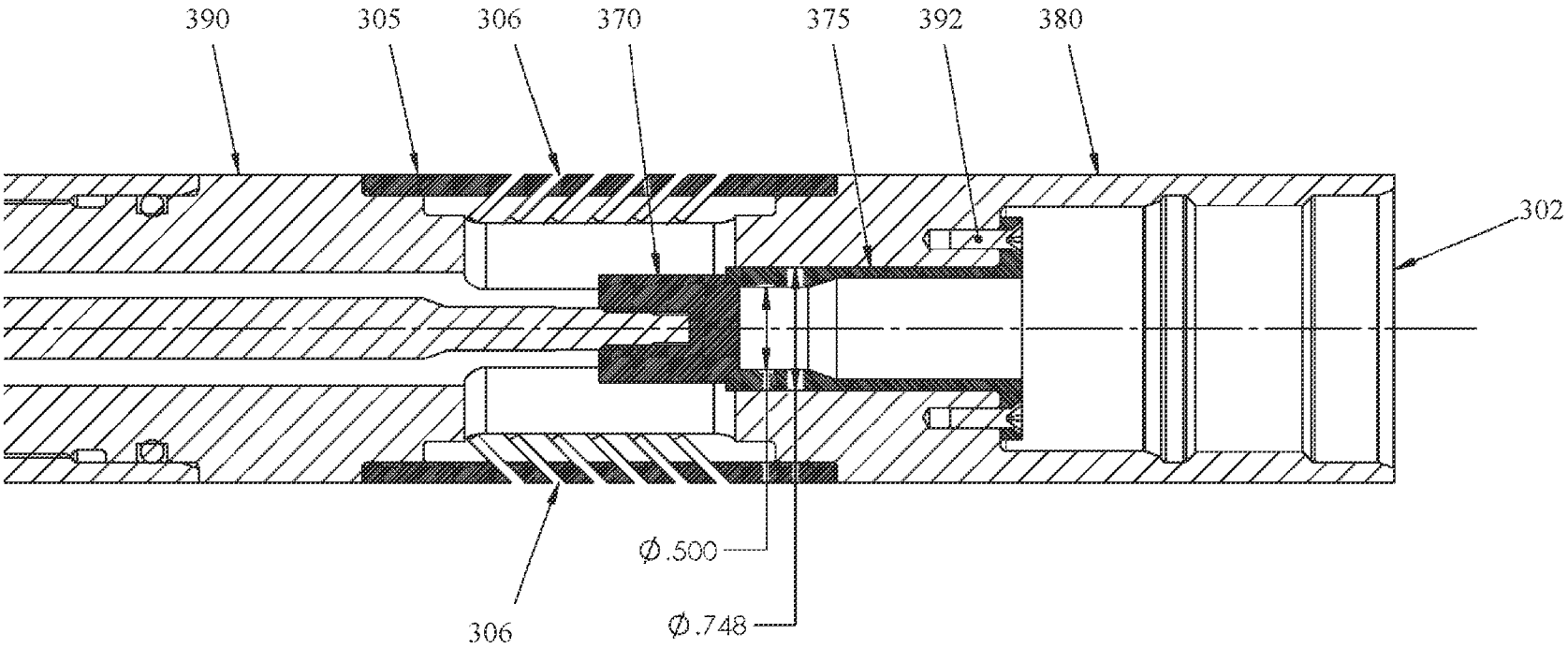
FIG. 5 is a schematic diagram showing a portion of a pulser according to an embodiment in FIG. 3.
Figure 6:
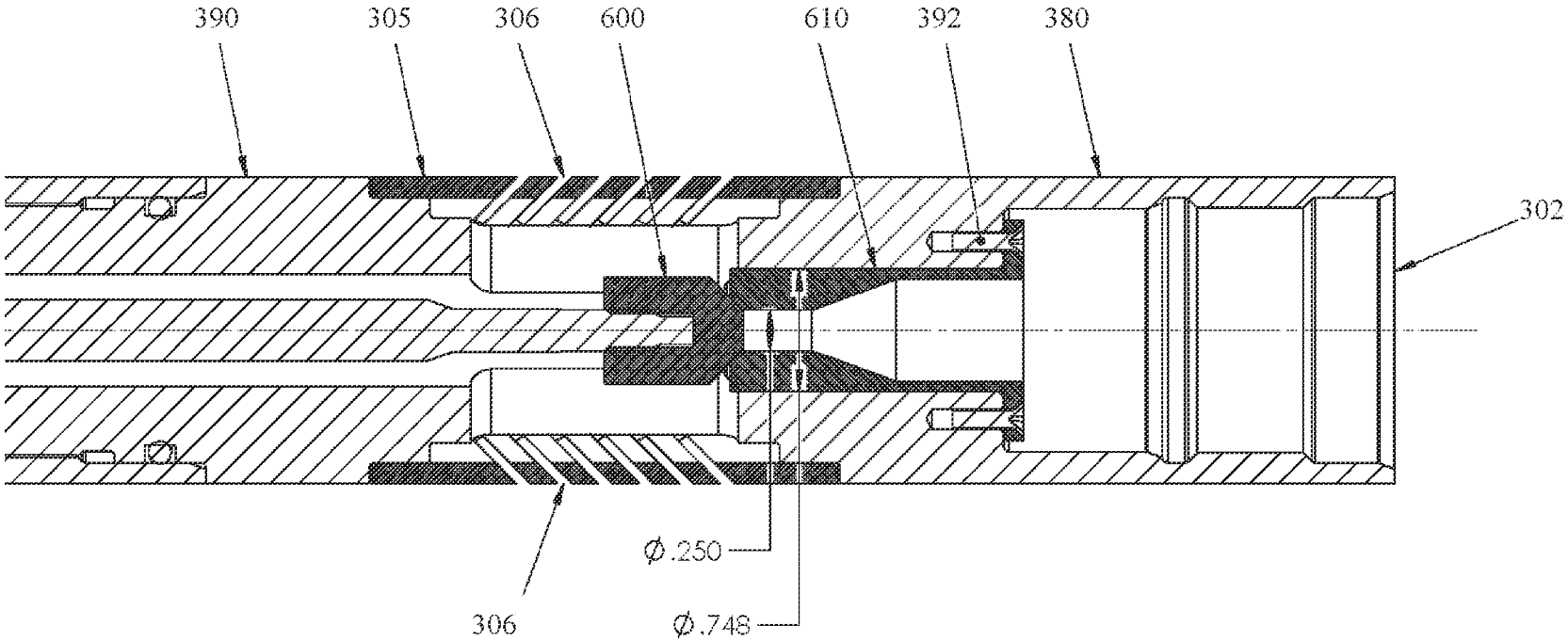
FIG. 6 is a schematic diagram showing a portion of pulser according to an embodiment.

FIG. 5 is a schematic diagram showing a portion of a pulser 300 according to an embodiment in FIG. 3 having a servo valve with a large ID. FIG. 6 is a schematic diagram showing a portion of pulser 300 according to an embodiment, which has a smaller ID than FIGS. 3 and 5. FIGS. 5 and 6 show poppet shaft 320 and the screen 305 having screen members 306, which preferably cut against the flow of the drilling fluid by an angle of approximately 45 degrees. However, the size of the poppet 370 and the thickness of the orifice member 375 in FIG. 5 are smaller than the size of a poppet 600 and an orifice member 610 in FIG. 6. The size of the poppet 600 and the size of the orifice member 610 in FIG. 6 provide an orifice having an inner diameter of approximately ¼ inches, and the size of the poppet 370 and the size of the orifice member 375 provide an orifice having an inner diameter of ½ inches. However, both orifice member 375 and orifice member 610 have the same outer diameter, so that the poppets and orifice members can be easily installed and removed for replacement.

While embodiments of this disclosure have been shown and described, modifications can be made by one skilled in the art without departing from the spirit or teaching of this invention. The embodiments described herein are exemplary only and are not limiting. Many variations and modifications of methods, systems and apparatuses are possible and are within the scope of the invention. Accordingly, the scope of protection is not limited to the embodiments described herein. The scope of protection is only limited by the claims. The scope of the claims shall include all equivalents of the subject matter of the claims.

What is claimed is:

1. A pulser for generating pressure pulses in a drilling fluid during a drilling operation, comprising:

a tubular housing;

a pressure compensation piston separating the tubular housing into a proximal portion and a distal portion;

a motor resides in the proximal portion;

a servo valve resides in the distal portion;

a poppet shaft coupled to the motor and extends through the pressure compensation piston into the distal portion, wherein the motor causes the poppet shaft to reciprocate along a longitudinal direction of the tubular housing;

one or more metal screens affixed to a surface of the distal portion of the tubular housing, configured to allow the drilling fluid to enter the tubular housing, wherein the servo valve comprises a poppet detachably affixed to the poppet shaft and an orifice member having an orifice that allows the drilling fluid to pass, wherein a reciprocating motion of the poppet shaft causes the poppet to close or open the orifice, thereby stopping or releasing a flow of the drilling fluid through the pulser, and wherein the pressure compensation piston has a first spiral pattern on an outer surface of the pressure compensation piston and has a second spiral pattern on an inner surface of the pressure compensation piston.

2. The pulser of claim 1, wherein each of the one or more metal screens includes a plurality of screen members positioned to form a plurality of slits to allow the drilling fluid to flow into a distal end of the tubular housing, wherein each of the plurality of slits is oriented so that a middle point of each slit is positioned distal to two ends of a corresponding slit.

3. The pulser of claim 1, further comprising an orifice housing disposed in the distal portion of the tubular housing, wherein the orifice member is detachably affixed to the orifice housing.

4. The pulser of claim 3, wherein the orifice in the orifice member has a diameter ranging from 0.2 inches to 0.5 inches, and the poppet has a size that matches the orifice.

5. The pulser of claim 3, wherein the orifice housing is detachably affixed to the tubular housing, wherein detaching the orifice housing from the tubular housing exposes the poppet so that the poppet is removable from the tubular housing.

6. The pulser of claim 1, further comprising a compression spring disposed in the distal portion of the tubular housing and exerts a force against the pressure compensation piston, wherein, during operation, the proximal portion is filled with a lubricant and the distal portion is filled with the drilling fluid, wherein the pressure compensation piston moves along the longitudinal direction of the tubular housing in response to a pressure difference between the lubricant and the drilling fluid.

7. The pulser of claim 6, wherein the first spiral pattern and the second spiral pattern each includes a plurality of spiral grooves of a rectangular shape, wherein the lubricant fills the plurality of spiral grooves of the first spiral pattern and of the second spiral pattern.

8. The pulser of claim 7, wherein each of the spiral grooves is about 1/16 inches wide and about 1/32 inches deep, and disposed about the inner surface or the outer surface of the pressure compensation piston at approximately one revolution for every two inches of a length of the pressure compensation piston.

9. The pulser of claim 6, further comprising a pressure balance plate disposed between the pressure compensation piston and the compression spring.

10. A method to prepare a pulser of claim 1 for operation, comprising:

estimating a depth of the pulser in a bore hole;

estimating an amplitude of pressure pulses required for the pressure pulses to propagate from the estimated depth to a surface;

selecting a diameter of the orifice and the poppet required for generating pressure pulses of the estimated amplitude; and installing the orifice member having the selected diameter of the orifice and the poppet in the pulser.

11. The method of claim 10, wherein the installation step comprises:

removing an orifice housing from the pulser;

affixing the poppet to the poppet shaft;

affixing the orifice member to the orifice housing; and installing the orifice housing with the orifice member to the pulser.

12. The method of claim 11, wherein the orifice member is selected from a plurality of orifice members having a common outer diameter, and each of the plurality of orifice members has an orifice of different diameter.

13. The method of claim 12, wherein the orifice in each of the plurality of orifice members has a diameter in ranging from 0.2 inches to 0.5 inches.

14. The method of claim 10, wherein the estimated amplitude of the pressure pulses is about 500 psi and the selected diameter of the orifice is 0.5 inches.

15. A pulser for generating pressure pulses in a drilling fluid during a drilling operation, comprising:

a tubular housing;

a pressure compensation piston separating the tubular housing into a proximal portion and a distal portion;

a motor resides in the proximal portion;

a servo valve resides in the distal portion;

a poppet shaft coupled to the motor and extends through the pressure compensation piston into the distal portion, wherein the motor causes the poppet shaft to reciprocate along a longitudinal direction of the tubular housing;

one or more metal screens affixed to a surface of the distal portion of the tubular housing, configured to allow the drilling fluid to enter the tubular housing;

a compression spring disposed in the distal portion of the tubular housing and exerts a force against the pressure compensation piston; and a first sealing ring that seals a gap between the pressure compensation piston and the tubular housing and a second sealing ring that seals a gap between the pressure compensation piston and the poppet shaft, wherein, during operation, the proximal portion is filled with a lubricant and the distal portion is filled with the drilling fluid, wherein the pressure compensation piston moves along the longitudinal direction of the tubular housing in response to a pressure difference between the lubricant and the drilling fluid, and wherein the servo valve comprises a poppet detachably affixed to the poppet shaft and an orifice member having an orifice that allows the drilling fluid to pass, wherein a reciprocating motion of the poppet shaft causes the poppet to close or open the orifice, thereby stopping or releasing a flow of the drilling fluid through the pulser.

16. The pulser of claim 15, wherein the first sealing ring is a first X-ring disposed about an outer surface of the pressure compensation piston and the second sealing ring is a second X-ring disposed about an inner surface of the pressure compensation piston.

* * * * *